United States Patent [19]

Rasmussen et al.

[11] Patent Number: 4,544,156

[45] Date of Patent: Oct. 1, 1985

[54] TOY POOL TABLE COMPONENTS

[75] Inventors: Russell G. Rasmussen, Skokie; Alice A. Peinsipp, Westchester; Jeffrey D. Breslow, Highland Park, all of Ill.

[73] Assignee: Marvin Glass & Associates, Chicago, Ill.

[21] Appl. No.: 567,575

[22] Filed: Jan. 3, 1984

[51] Int. Cl.[4] ..... A63D 3/00

[52] U.S. Cl. ..... 273/5 A; 273/9; 273/12

[58] Field of Search ..... 273/4 R, 4 B, 5 A, 8, 273/9, 129 R, 125 R, 119 R, 123, 298, 85 R

[56] References Cited

U.S. PATENT DOCUMENTS

| | | | |
|---|---|---|---|
| 302,196 | 7/1884 | Eulass | 273/5 A |
| 704,892 | 7/1902 | Lowerre | 273/9 |
| 736,938 | 8/1903 | Clark | 273/8 |
| 869,718 | 10/1907 | Knudson | 273/5 A |
| 1,255,542 | 2/1918 | Cour | 273/5 A |
| 1,661,965 | 3/1928 | Ruse et al. | 273/5 |
| 1,670,608 | 5/1928 | Christoph | 273/5 A |
| 4,132,411 | 1/1979 | Breslow | 273/123 R |

FOREIGN PATENT DOCUMENTS

| | | | |
|---|---|---|---|
| 5649 | of 1890 | United Kingdom | 273/5 A |

*Primary Examiner*—Richard C. Pinkham
*Assistant Examiner*—T. Brown
*Attorney, Agent, or Firm*—John S. Pacocha

[57] ABSTRACT

Toy pool table components permit conversion of a card table or other similar piece of furniture having a substantially planar horizontal surface into a toy pool table. Each of a number of ball receiving pockets has a clamping mechanism for mounting the pocket on the edge of the top of the piece of furniture. An upper "U" shaped bracket receives balls from the playing surface through the opening of the "U". Two spaced apart ratchet bars depend downwardly from each side of the bracket. Arms supporting a lower brace slide up and down along the ratcheted bars and each arm has a pawl that engages the ratchet teeth to adjust the pocket clamp to accommodate a wide range of table top thicknesses. A hollow cup for retaining the balls is removably seated within the bight section of the bracket. Elastic bands extending between adjacent pockets bias the pockets into engagement with the card table and provide a resilient cushion for soft rubber or foam balls between the pockets.

20 Claims, 7 Drawing Figures

TOY POOL TABLE COMPONENTS

BACKGROUND OF THE INVENTION

1. Field of the Invention

This invention relates generally to toy pool tables and more particularly to the pocket and cushion components.

2. Background Art

Pool or billiard tables have long provided entertainment for adults and children. Examples of prior art toy pool tables and games resembling pool are found in U.S. Pat. Nos. 3,807,735; 4,039,191; and 4,132,411. All of such prior art toys have an integral pool table with a playing surface, cushions, and ball receiving pockets. While such prior art integral pool tables provide entertaining play, the requirements of portability and storage limit the size of playing surface as well as the size of the balls that may be used. A set of toy pool table components that could be attached to a commonly available piece of furniture such as a card table, coffee table, or other table or desk top having an edge projecting out beyond the recessed vertical support or legs would be desirable. Of course, the components would have to be readily adjustble to accommodate a wide range of various table top thicknesses. In addition, it would be desirable to employ relatively soft balls, as compared to the regulation hard pool balls, to avoid damage to the table top. Moreover, such soft balls would be safer for play by young children. Accordingly, the toy pool table components would have to include boundary rails between the pockets that provide rebounding cushions for such soft balls.

SUMMARY OF THE INVENTION

The present invention is concerned with providing toy pool table components that may be readily attached to a wide variety of tables, desks, or other commonly available furniture having a generally horizontal planar surface with portions of the periphery clear of legs or other vertical supports. These and other objects and advantages are achieved by ball receiving pockets that each have a generally horizontally disposed "U" shaped bracket with the ball receivable through the opening in the "U". A pair of spaced apart ratchet bars depend downwardly from either side of the "U" and a lower brace is coupled to the bars for vertical adjustment so that a wide range of thicknesses of furniture tops may be clamped between the bracket and the brace. Each of the bars has ratchet teeth and the brace carries pawls that engage the ratchet teeth to arrest vertical movement of the brace once it is adjusted. A hollow cup is removably seated within the bight of the "U" to retain the balls. Elastic boundary rails extend between adjacent pockets to bias the pockets into engagement with the edge of the top and to provide a resilient cushion for soft rubber or foam balls.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
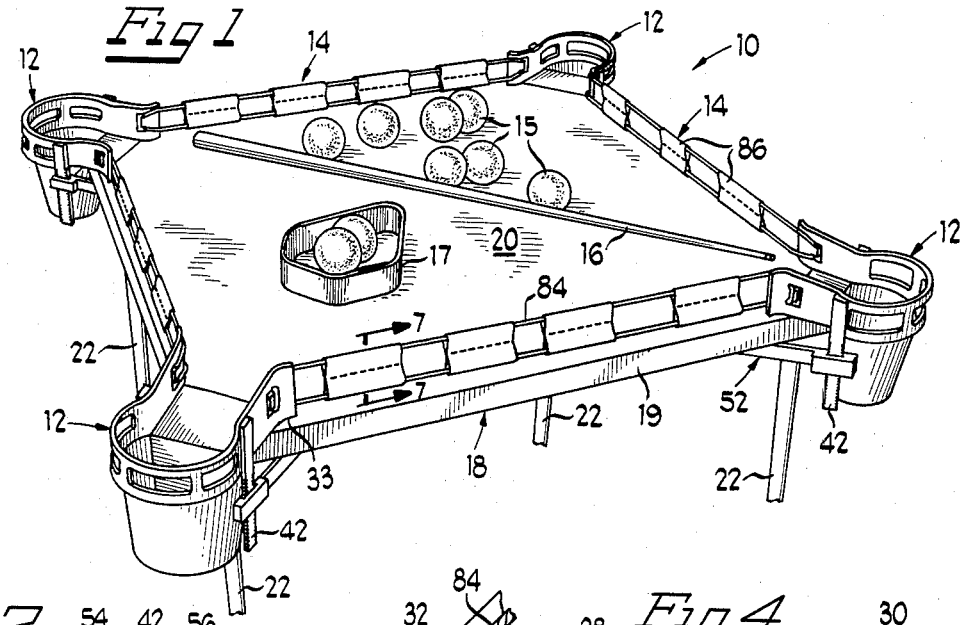
FIG. 1 is a perspective view of one embodiment of the present invention mounted on a card table.

Referring now to the drawing in which like reference characters are used for like parts throughout the several views, there is shown in FIG. 1 an assembled toy pool table 10 utilizing the components of the present invention. In addition to pocket assemblies 12 and elastic cushion rails 14, nine balls 15 of a soft rubber or foam are supplied to provide eight object balls and a cue ball. A conventional cue stick 16 or some other means for propelling the cue ball by impact are also supplied slong with an eight ball rack 17. The pocket assemblies 12 and the elastic boundaries 14 have been mounted on a card table 18 having a top 19 which provides a substantially horizontal planar playing surface 20.

Table 18 has corner legs 22 recessed in from the periphery of the table top 19 to space the table top from the floor. The components of the present invention may be attached to virtually any card table, coffee table,-kitchen table, or other piece of furniture providing a table top, desk top, or other substantially planar surface as long as the top is supported so that at least parts of the periphery are clear of the support. Generally, the invention may be used with pieces of furniture that have a top or slab that has a peripheral edge thickness, or is combined with a depending peripheral skirt to present an effective peripheral edge thickness, of from a quarter of an inch to as much as four inches.

Figure 2:
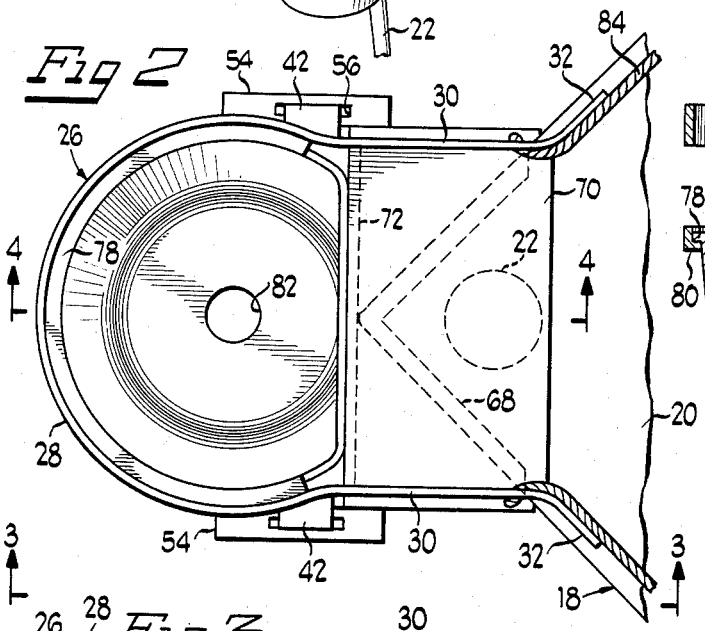
FIG. 2 is an enlarged scale, fragmentary, top plan view of one corner of the assembled toy pool table shown in FIG. 1.
Figure 4:
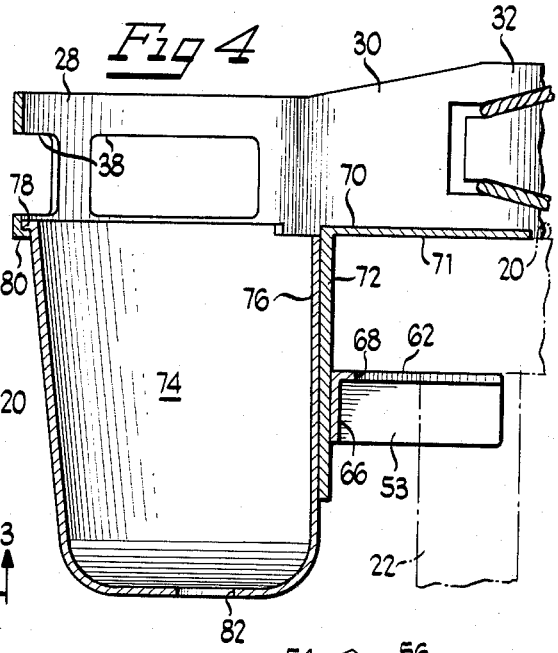
FIG. 4 is a vertical sectional view taken generally along the line 4—4 of FIG. 2.

Pocket assemblies 12 each have a generally horizontally disposed "U" shaped bracket 26 that includes a bight section 28 and spaced apart straight sections 30 extending from the bight section. Each straight section 30 terminates in a free end portion 32 that is angled away from the opening of the "U" approximately 45 degrees from the line along which the straight section 30 lies. Thus, as is best illustrated in FIG. 2 the free end portion 32 forms an angle of approximately 135 degrees with the straight section 30 as measured from the outside of the "U". The bottom edge or lower surface 33 of the terminal or free end portion 32 bears upon a part of the surface 20 of the table top 19. Bight section 28 projects outboard of the table periphery.

As shown in the drawings, each straight section 30 is provided with a "C" shaped cutout 34 forming a tab 36. However, the cutout and tab could instead be formed in the free end portion 32. A number of cutouts 38 are also provided in the bight section 28 for purposes of appearance and to reduce the amount of material required to form the bracket 26.

Depending downwardly from the bracket 26 adjacent the intersection of the bight section 28 with a straight section 30 is a ratchet bar 42. Along the depending portions of both the inward facing edge 44 and the outward facing edge 46 of each of the bars 42 are ratchet teeth 48 and 50, respectively. The slope of the upward facing side of each tooth 48 is substantially horizontal while the downward facing side of each tooth has a slope that intersect the upper facing side to form an acute angle. Teeth 50 are formed in an opposite manner to the teeth 48 so that the downward facing side of each tooth 50 is substantially horizontal while the upward facing side has a slope that intersects the lower side to form an acute angle. Opposed teeth 48 and 50 are spaced such that an extension of the upper face of a tooth 48 and lower face of a tooth 50 will lie substantially upon the same horizontal line.

In order to accommodate table tops having an effective peripheral edge thickness of up to four inches the bars 42 depend down about five inches below the bracket 28. There should be at least four teeth to an inch along each of the edges 44 and 46 to provide sufficient increments of adjustment and five teeth to the inch is preferred.

Each ratchet bar 42 carries a cantilevered arm 52 which includes an inner end 53 and an outer end 54. Adjacent the outer end 54, the arm includes a slot 56 extending through the depth or thickness of the arm 52. The slot 56 is sufficiently long and wide to receive the ratchet bar 42. Positioned within the slot 56 are a pair of opposed pawl teeth 58 and 60. Pawl tooth 58 is disposed near the bottom of the slot 56 and extends into the slot from the side of the inner end of the arm while tooth 60 is disposed near the top of the slot and extends into the slot from the outer end 54.

Figure 3:
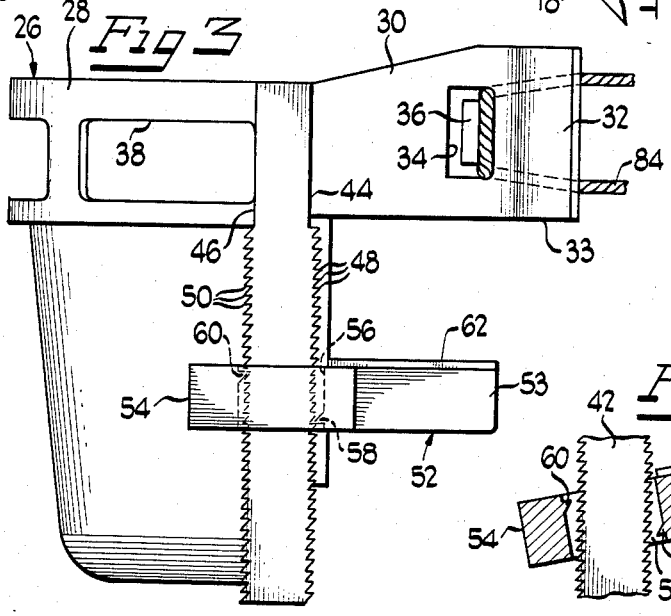
FIG. 3 is a fragmentary, side elevational view taken generally along the line 3—3 of FIG. 2.
Figure 5:
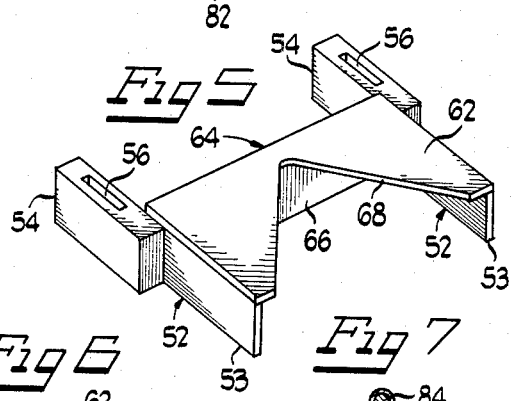
FIG. 5 is an enlarged scale, perspective view of the lower brace of the pocket assembly.
Figure 6:
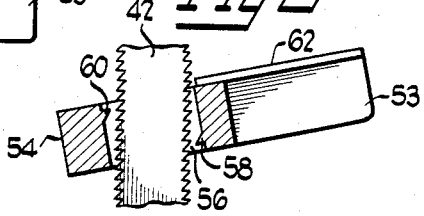
FIG. 6 is an enlarged scale, fragmentary, sectional view of the ratchet bar and arm pawl mechanism.
Figure 7:
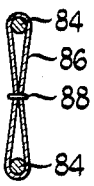
FIG. 7 is an enlarged scale sectional view taken generally along the line 7—7 of FIG. 1.

As illustrated in FIGS. 3 and 6, pawl tooth 58 which engages the ratchet teeth 48 has a substantially horizontal slope on its underside while the slope of the upper side is such as to form an acute angle with the underside. The slopes of the faces of the pawl tooth 60 are opposite that of pawl tooth 58; that is, the upper side of the tooth 60 has a substantially horizontal slope while the underside has a slope such that an acute angle is formed by the intersection of the two faces. Teeth 58 and 60 are spaced apart vertically a distance substantially equal to a whole number of teeth on the ratchet bar. Accordingly, when pawl tooth 58 engages a ratchet tooth 48 the horizontal sloping faces of the engaging teeth lock together preventing downward movement and when the pawl tooth 60 engages one of the ratchet teeth 50 the horizontal sloping faces again lock together preventing upward movement.

Spaced apart arms 52 are attached to an abutment 62 that spans across the portion of the arms adjacent the inner end 53. Abutment 62 and arms 52 form a lower brace 64 that is vertically movable along the ratchet bars 42. Together with the lower bearing surface 33, the movable brace 64 forms an adjustable clamp for mounting the pocket assembly 12 along the clear portion of the periphery of a card table or similar piece of furniture. Cross piece 66 underlying the abutment 62 strengthens the brace 64. In order to accommodate corner legs 22 that are positioned near the periphery of the table, a "V" shaped notch 68 is provided in the abutment 62.

Secured to the bracket 26 between the straight sections 30 is a ramp 70. The underside 71 of the ramp bears upon a portion of the table top to which the pocket assemblies are attached as is best illustrated in FIG. 2. Depending downwardly from the backside of the ramp 70 is a vertical wall 72 which abuts the peripheral side edge or corner edge of the table top 19 when the pocket assembly 12 is attached. The upper surface of the ramp 70 provides a communicating surface between the planar playing surface 20 of the table and the opening in the bight section 28 of the bracket for the balls 15. A removable cup 74 is provided for holding the balls.

Cup 74 is generally a circular cylinder but has one straight wall section 76 which abuts the vertical wall 72. Along the open upper edge of the circular part of the cup there is an outwardly projecting rim 78. Bracket 26, or more particularly the bight section 28, is provided with an inwardly extending lip 80 along the lower edge. Thus, the cup 74 may be inserted through the top of the bracket 26 and is retained by engagement of the extending rim 78 with the lip 80 in a position such that the upper open end adjacent the flat wall section 76 is disposed slightly below the top surface of the ramp 70 to receive and retain the balls. Although the cup 74 is shown as substantially solid except for the circular opening 82 in the bottom wall of the cup, the cup may be provided with a number of cutouts to save on material costs and to simulate the leather lattice work type construction employed in some full size pool tables.

The adjustable clamp provided by the movable brace 64 together with the lower bearing surfaces 33 of the portions of the bracket adjacent the free ends 32 and the lower surface 71 of the ramp 70 initially secures a pocket assembly 12 to the table 18. However, the pocket assembly could be dislodged by a lateral force from the playing surface 20 such as might occur from a ball 15 hitting the pocket assembly. Accordingly, adjacent pocket assemblies 12 are connected by an elastic rail member 14 to bias the vertical wall 72 into contact with the peripheral edge of the table 18. For this purpose, each end of a loop of elasticized cord 84 is slipped through a "C" shaped slot 34 and over tab 36. Thus, with each pocket assembly 12 having a stretched loop 84 pulling on each side of the "U" shaped bracket, the pocket assembly 12, or more particularly the vertical wall 72, is biased into engagement with the peripheral edge of the table 18 against a lateral force from inside the playing surface 20.

In addition to biasing the pocket assemblies 12 into engagement with the table, strands of elasticized cord 84 provide a resilient rebounding cushion for the balls 15 between the pockets. To enhance the cushion function of the loops 84, vertical webs 86 are provided at periodic intervals. Each of the webs consists of a sleeve of fabric with some center stitching 88 to restrict the movability of the webs 86 along the elasticized loop 84 while permitting some repositioning of the webs to accommodate the differing lengths of a cushion that will result from mounting the pocket assemblies on different sized table tops.

In addition to the four corner pocket assemblies 12 that are illustrated in the drawing, two addlitional side pocket assemblies (not shown) may be supplied to assemble a toy pool table even more closely resembling a standard six pocket pool table. The side pocket assemblies would only differ from the corner pocket assemblies 12 in the angle of the portions adjacent the free ends 32 relative to the sections 30. For the side pockets, the angle, either with an extension of the line along the straight section 30 or as measured from the outside of the "U", would be a 90 degree angle.

While a particular embodiment has been illustrated and described together with one modification of the present invention, it will be apparent that various changes and further modifications will occur to those skilled in the art. It is intended in the following claims to cover all such changes and modifications as fall within the true spirit and scope of the present invention.

What is claimed as new and desired to be secured by Letters Patent is:

1. Toy pool table components adapted to be attached to a piece of furniture having a top with a substantially horizontal upper planar surface and a periphery of finite thickness spaced from the floor by support means such that at least parts of the periphery are clear of the support means comprising:

a plurality of ball receiving pockets mountable adjacent a portion of the periphery;

each pocket having an opening for receiving a ball from the horizontal planar surface;

elastic boundary means extending between adjacent pockets for biasing the pockets into engagement with the top and for providing a resilient cushion for balls between the pockets;

each pocket including a bracket having a portion with a lower surface for bearing upon the horizontal upper planar surface;

the bracket being generally "U" shaped with spaced apart, generally straight sections extending out from a bight section;

each of the straight sections having a free end opposite the bight section;

a portion of each of the straight sections adjacent the free end overlying the horizontal upper surface and the bight portion projecting outboard of the periphery;

a member depending downwardly from each straight section;

a cantilevered arm carried by each member below the bracket for vertical movement of the arm along the member from a position in which the uppermost portion of the arm is proximate the lower surface of the bracket to any one of a plurality of selectable spaced positions for accommodating different thicknesses of the periphery of the top;

the arm having an inner end that extends beneath the horizontal planar surface and an opposed outer end;

the arm including an opening adjacent the outer end for receiving the member; and means positioned within the opening engaging means on the member to control the vertical movement of the arm.

2. The toy pool table components of claim 1 including four corner pockets for combining with the elastic means and horizontal surface to form a rectangular pool table.

3. The toy pool table components of claim 2 including two side pockets each mountable between an opposed pair of the corner pockets.

4. The toy pool table components of claim 1 in which each member depends downwardly from the bracket adjacent the intersection of a straight section with the bight section.

5. The toy pool table components of claim 1 in which the means on the member are on opposed faces of the member.

6. The toy pool table components of claim 5 in which opposed means are not aligned.

7. The toy pool table components of claim 1 in which the means are teeth.

8. The toy pool table components of claim 7 in which there are at least four teeth per inch on the bar.

9. The toy pool table components of claim 1 in which the bracket has a "V" shaped notch open toward the piece of furniture for accommodating the furniture support means.

10. The toy pool table components of claim 1 in which:

the bight section has an inwardly projecting lip exposed below the horizontal upper planar surface; and ball receiving means are seatable in the bracket depending below the upper horizontal planar surface and retained by engaging the lip.

11. Toy pool table components adapted to be attached to a piece of furniture having a top with a substantially horizontal upper planar surface and a periphery of finite thickness spaced from the floor by support means such that at least parts of the periphery are clear of the support means comprising:

a plurality of ball receiving pockets mountable adjacent a portion of the periphery;

each pocket having an opening for receiving a ball from the horizontal planar surface;

elastic boundary means extending between adjacent pockets for biasing the pockets into engagement with the top and for providing a resilient cushion for balls between the pockets;

each pocket including a bracket having a portion with a lower surface for bearing upon the horizontal upper planar surface;

a bar depending downwardly from the bracket;

a brace carried by the bar below the bracket for vertical movement of the brace along the bar from a position in which the uppermost portion of the brace is proximate the lower surface of the bracket to any one of a plurality of selectable spaced positions for accommodating different thicknesses of the periphery of the top;

the bracket being generally "U" shaped with straight, spaced apart sections extending from a bight section;

each of the straight sections having a free end opposite the bight section;

portions of the straight sections adjacent the free ends overlying the horizontal upper surface and the bight section projecting outboard of the periphery;

the bight section having an inwardly projecting lip disposed below the upper horizontal planar surface; and a hollow ball receiving cup having an outwardly projecting rim along a segment of the upper edge being seatable in the bracket with the rim engaging the lip.

12. Toy pool table components adapted to be attached to a piece of furniture having a top with a substantially horizontal upper planar surface and a periphery of finite thickness spaced from the floor by support means such that at least parts of the periphery are clear of the support means comprising:

a plurality of ball receiving pockets mountable adjacent a portion of the periphery;

each pocket having an opening for receiving a ball from the horizontal planar surface;

elastic boundary means extending between adjacent pockets for biasing the pockets into engagement with the top and for providing a resilient cushion for balls between the pockets;

each pocket including a bracket having a portion with a lower surface for bearing upon the horizontal upper planar surface;

a bar depending downwardly from the bracket;

a brace carried by the bar below the bracket for vertical movement of the brace along the bar from a position in which the uppermost portion of the brace is proximate the lower surface of the bracket to any one of a plurality of selectable spaced positions for accommodating different thicknesses of the periphery of the top;

the bar having opposed inward and outward vertical edges;

one vertical edge having ratchet teeth;

the brace including an arm having an inner end that extends beneath the horizontal planar surface and an opposed outer end;

the arm including a slot adjacent the outer end for receiving the bar; and a pawl tooth positioned within the slot for engaging the ratchet teeth to arrest the vertical movement of the arm along the bar.

13. The toy pool table components of claim 12 in which:

the bar also has ratchet teeth on the other opposed edge; and another pawl tooth is positioned within the slot for engaging the ratchet teeth on the other opposed end to arrest vertical movement of the bar.

14. The toy pool table components of claim 13 in which:

the ratchet teeth along the inward edge have an essentially horizontal slope on the upper side; and the pawl tooth positioned within the slot for engaging the inward ratchet teeth has an essentially horizontal slope along the lower side of the tooth when the arm is disposed horizontally.

15. The toy pool table components of claim 14 in which:

the teeth along the outward edge have an essentially horizontal slope on the lower side; and the pawl tooth positioned within the slot for engaging the outward ratchet teeth has an essentially horizontal slope along the upper side of the tooth when the arm is disposed horizontally.

16. The toy pool table components of claim 12 in which there are at least four teeth per inch on the bar.

17. The toy pool table components of claim 12 in which:

the bracket has two spaced apart sections each partially overlying the horizontal upper planar surface;

the one bar depends downwardly from one of the sections and a second bar depends downwardly from the other of the sections; and the one arm of the brace is carried by the one bar and the brace has a second arm carried by the second bar for substantially parallel vertical movement of the second arm along the second bar.

18. The toy pool table components of claim 17 in which:

the second bar has opposed inward and outward vertical edges;

one vertical edge of the second bar has ratchet teeth;

the second arm has an inner end that extends beneath the horizontal planar surface and an opposed outer end;

the second arm includes a slot adjacent the outer end for receiving the second bar; and a pawl tooth is positioned within the slot of the second arm for engaging the ratchet teeth of the second arm to arrest vertical movement of the second arm along the second bar.

19. The toy pool table components of claim 17 in which:

the brace includes an abutment carried by two arms; and the abutment has a "V" shaped notch open toward the piece of furniture for accommodating the furniture support means.

20. A toy pool game comprising:

a plurality of balls;

a playing surface;

impact means for propelling the balls upon the playing surface;

a plurality of ball receiving pockets mountable on the playing surface;

each pocket including a bracket having portions bearing upon the playing surface;

spaced apart bars depending downwardly from each bracket;

each pocket including a brace having spaced apart arms with each arm carried by one of the depending bars permitting vertical movement of the brace toward and away from the portions of the bracket bearing upon the playing surface;

at least one of the bars depending from each bracket having ratchet teeth along one vertical edge;

one of the arms of each brace having a slot receiving the bar having the ratchet teeth and having a pawl tooth positioned within the slot for engaging the ratchet teeth to arrest the vertical movement of the brace; and elastic means extending between adjacent pockets for biasing the pockets into engagement with the playing surface and for providing a resilient cushion for the balls between the pockets.

* * * * *